US005865192A

United States Patent [19]

Sealy

[11] Patent Number: 5,865,192

[45] Date of Patent: Feb. 2, 1999

[54] SELF-HAIRCUTTING GUIDE APPARATUS

[76] Inventor: Barry Sealy, 2230 Snyder Ave., Philadelphia, Pa. 19145

[21] Appl. No.: 136,972

[22] Filed: Aug. 20, 1998

[51] Int. Cl.[6] ..... A45D 24/36; A45D 24/34; B26B 13/00

[52] U.S. Cl. ..... 132/214; 132/214; 30/233

[58] Field of Search ..... 132/214, 212, 132/213; 30/123, 233, 286

[56] References Cited

U.S. PATENT DOCUMENTS

| | | | |
|---|---|---|---|
| 2,542,450 | 2/1951 | Altman . | |
| 2,698,018 | 12/1954 | Post . | |
| 2,765,797 | 10/1956 | Potente | 132/45 |
| 2,917,055 | 12/1959 | Fouche | 132/45 |
| 3,180,341 | 4/1965 | Dumont | 132/214 |
| 3,202,158 | 8/1965 | Dumont . | |
| 3,272,209 | 9/1966 | Kraus | 132/214 |
| 3,972,075 | 8/1976 | Alveras . | |
| 4,106,515 | 8/1978 | Miller | 132/214 |
| 4,137,925 | 2/1979 | Castillo | 132/214 |
| 5,577,520 | 11/1996 | Sluder . | |

*Primary Examiner*—John J. Wilson
*Assistant Examiner*—Trang Doan
*Attorney, Agent, or Firm*—Dinesh Agarwal

[57] ABSTRACT

A self-haircutting guide apparatus includes a flexible band for securing around a person's head and a haircutting guide which includes first and second ends. The guide is detachably mounted to the band at one of the first and second ends thereof and includes first and second generally opposed channel members which define therebetween a recess for allowing the hair to extend therethrough. At least one of the channel members includes a track for guiding a haircutting instrument, such as a hair-clipper or scissors or the like, between the channel members.

14 Claims, 3 Drawing Sheets

SELF-HAIRCUTTING GUIDE APPARATUS

FIELD AND HISTORICAL BACKGROUND OF THE INVENTION

The present invention is directed to haircutting devices, and more particularly to a self-haircutting guide apparatus which allows a person to cut his or her hair uniformly and accurately.

Various haircutting devices are available in the art, as shown in U.S. Pat. Nos. 2,542,450; 2,698,018; 3,202,158: 3,972,075; and 5,577,520. These devices, however, suffer from various disadvantages in that they are either directed to cut someone else's hair or are not very effective in cutting a person's own hair. In addition, these devices are not very effective in uniform and precise haircutting and require some additional means to draw the hair out through the device before cutting. This poses a particular problem for those who have curly hair.

Finally, the conventional devices do not allow the flexibility of angled or streak-cutting of hair, such as providing a slanted cut on the side of a person's head extending from the front to rear.

In view of the disadvantages associated with the conventional haircutting devices, there is a need in the industry for a haircutting guide apparatus which allows a person to more uniformly and precisely cut his or her own hair.

OBJECTS AND SUMMARY OF THE INVENTION

The principal object of the present invention is to provide a self-haircutting guide apparatus which allows a person to more precisely and uniformly cut his or her own hair without requiring some extra means to draw the hair out through the apparatus.

An additional object of the present invention is to provide a self-haircutting guide apparatus which allows for more uniform cutting of hair throughout a person's head.

Yet an additional object of the present invention is to provide a self-haircutting guide apparatus which allows for selective and uniform-length cutting of hair throughout a person's head.

Another object of the present invention is to provide a self-haircutting guide apparatus which allows for angled cutting of hair.

Yet another object of the present invention is to provide a self-haircutting guide apparatus which allows for streak-cutting of hair.

In summary, the main object of the present invention is to provide a haircutting guide apparatus which allows a person to more uniformly and accurately cut his or her own hair. The device according to the invention includes a flexible band for securing around a person's head and a haircutting guide which includes first and second ends. The guide is detachably mounted to the band at one of the first and second ends thereof and includes first and second generally opposed channel members which define therebetween a recess for allowing the hair to extend therethrough. At least one of the channel members includes a track for guiding a haircutting instrument, such as a hair-clipper or scissors or the like, between the channel members.

BRIEF DESCRIPTION OF THE DRAWINGS

The above and other objects, novel features, and advantages of the present invention will become apparent from a review of the detailed description of the invention and the accompanying drawings, in which.

DETAILED DESCRIPTION OF THE INVENTION

Figure 1:
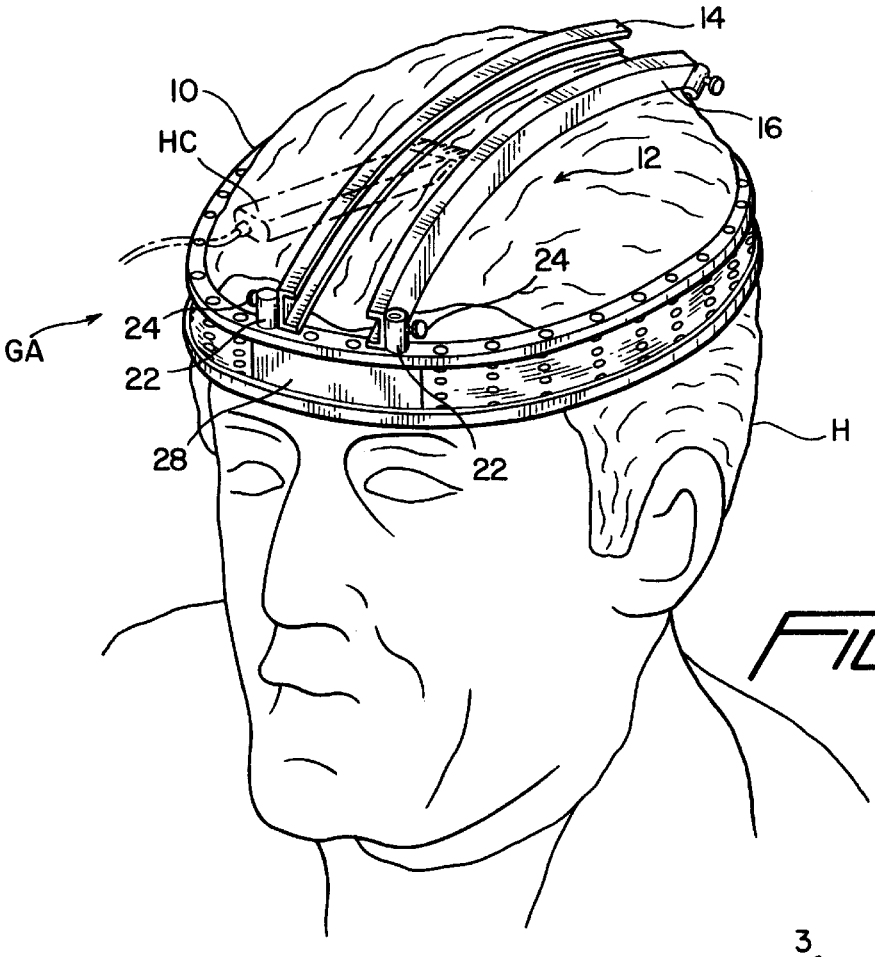
FIG. 1 is a front perspective view of the self-haircutting guide apparatus of the invention, shown positioned for use on a person's head.

As best shown in FIG. 1, the self-haircutting guide apparatus GA of the present invention includes a band 10 made of a flexible, yet durable material that can withstand continuous usage without deteriorating, such as hard plastic or aluminum. Preferably, the band 10 is about ¼ to ½ inch in width and has a length to accommodate various head sizes.

Figure 4:
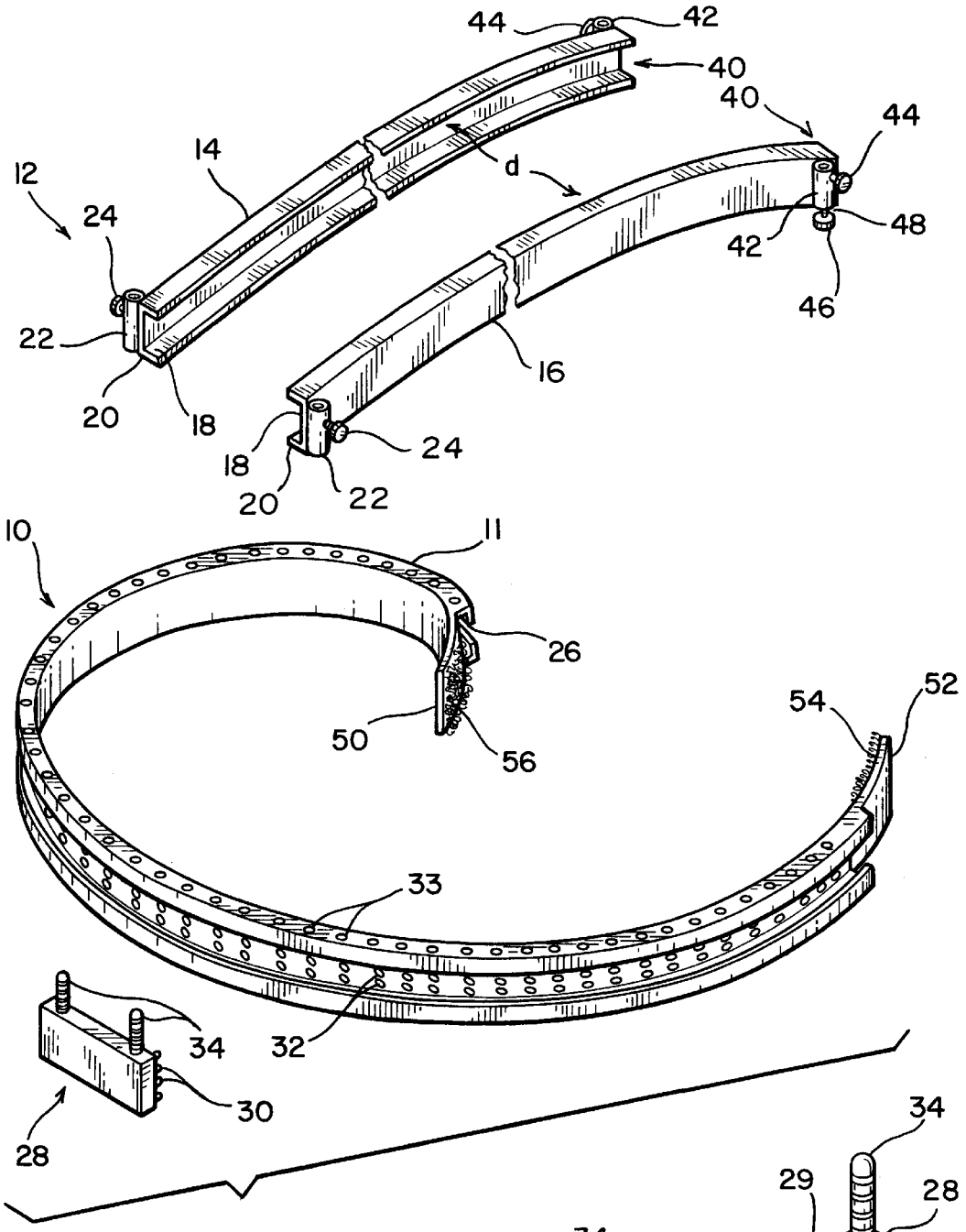
FIG. 4 is an exploded view of the guide apparatus shown in FIG. 1.

The guide apparatus GA further includes a haircutting guide 12, which is preferably made of same material as the band 10, and includes a pair of generally opposed channel members 14 and 16. As best shown in FIG. 4, each channel member 14 and 16 is generally U-shaped and defines a track 18. Each of the channel members 14 and 16 has mounted thereto adjacent the front end 20 thereof, a tubular member 22 with a screw-threaded fastener 24 (see FIGS. 2 and 4).

Figure 3:
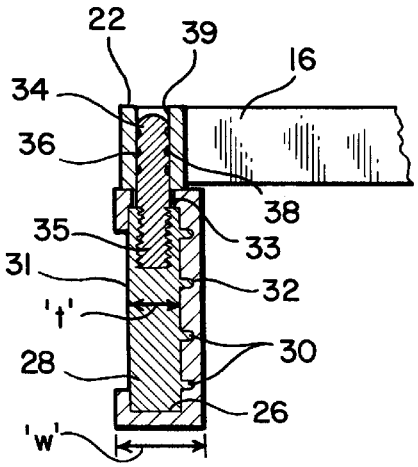
FIG. 3 is a cross-sectional view taken along line 3—3 of FIG. 2.

As best shown in FIGS. 3–4, the band 10 is generally C-shaped in cross-section and defines a recess 26. An anchor member 28 is slidably received in recess 26, and includes two vertical rows of projections 30 which are received in corresponding holes 32 in band 10 (see FIGS. 3–5). Two upwardly extending pins 34 are screw-threadingly provided in the anchor member 28, for receiving corresponding tubular members 22 of channel members 14 and 16 (see FIGS. 1–3).

Figure 2:
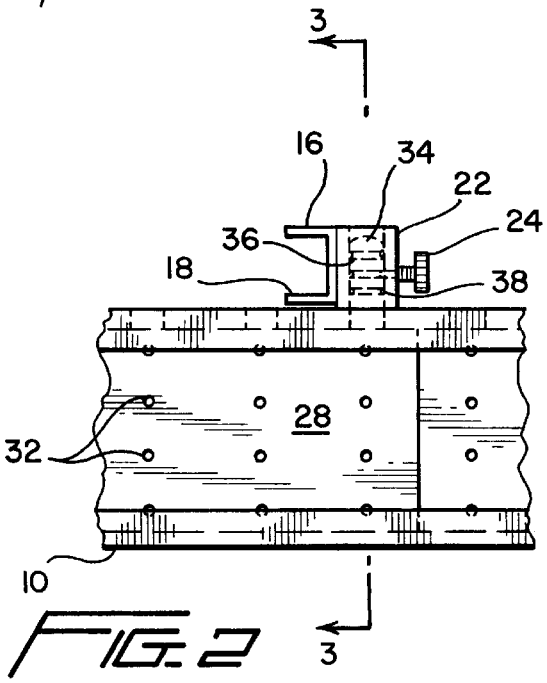
FIG. 2 is a partial, front elevational, enlarged view of the of the guide apparatus shown in FIG. 1.
Figure 5:
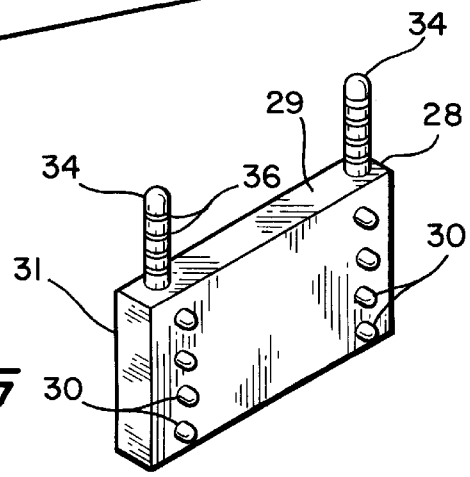
FIG. 5 is an enlarged perspective view of the slidable anchor member.

As best shown in FIGS. 2–3 and 5, each pin 34, preferably includes vertically spaced, circular depressions 36 which correspond with ridges 38 provided on the internal periphery 39 of tubular members 22. The depressions 36 and ridges 38 provide a tight frictional engagement therebetween to thereby securely fasten the channel members 14 and 16 to the anchor member 28.

The anchor member 28 is preferably made of a strong, yet somewhat resilient material such that the projections 30 can be easily snapped into and out of the corresponding holes 32 in band 10. This is due to the fact that the thickness 't' of the anchor member 28 preferably corresponds to the width 'w' of the recess 26 in band 10 for a snug fit. (It is noted herewith that if the anchor member 28 is made of a material which is not resilient, such as a metal, the thickness 't' of the anchor member 28 can be made slightly less than the width 'w' of the recess 26, to allow easy snapping-off and snapping-on of the projections 30 in corresponding holes 32 in band 10.)

As best shown in FIG. 4, the rear ends 40 of the channel members 14 and 16, include rear tubular members 42 with an associated screw-threaded fastener 44, in the same manner as the tubular members 22. Each of the rear tubular 42 member receives a cushion member 46 mounted on a corresponding stem 48. By manipulating the screw-threaded fastener 44, the length of the corresponding stem 48 extending below the channel member 14 or 16 maybe adjusted.

As further shown in FIG. 4, the free ends 50 and 52 of the band 10 are provided with a conventional fastener, such as hooks 54 and loops 56 for connecting the ends together when using the guide apparatus GA on a person's head.

Figure 6:
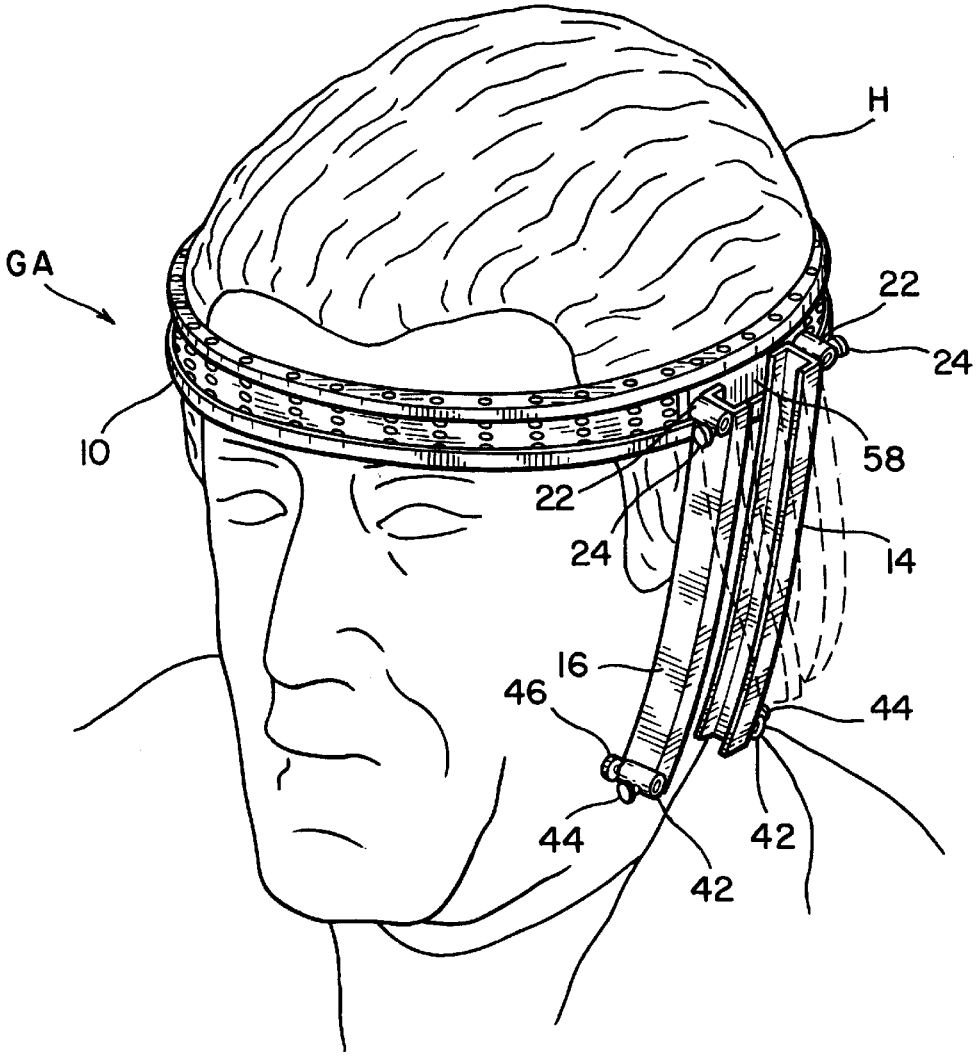
FIG. 6 is a view similar to FIG. 1, showing the device in use for cutting the side hair and showing in phantom lines a position of the device for angled cutting of hair.
Figure 7:
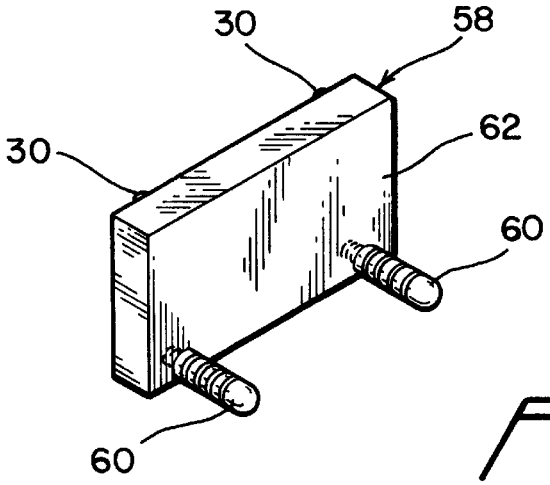
FIG. 7 is an enlarged view of the anchor member for use in cutting the side hair.

FIG. 6–7 illustrate another embodiment of the guide apparatus GA of the present invention, which is similar to the embodiment shown in FIGS. 1–5, with the exception that the anchor member 58 has the pins 60 extending transversely to the vertical plane of the anchor member 58. In other words, the pins 34 of the anchor member 28 shown in FIG. 5, extend vertically upwardly in the same plane as the anchor member 28. In the embodiment shown in FIG. 7, however, the pins 60 extend transversely to the vertical surface 62 thereof so that the channel members 14 and 16 can extend downwardly (FIG. 6), or upwardly, to cut hair across a person's head. (It is noted herewith that although a separate anchor member is shown to allow cutting of the side hair, the anchor member 28 shown in FIG. 5, may include holes on its side 31 for mounting the pins transversely thereto. In particular, pins 34 can be unscrewed from the top 29 of anchor member 28 and mounted on the side 31 opposite to where projections 30 are provided and be used for the purpose shown in FIG. 6–7.)

USE AND OPERATION

In use, a person secures the guide apparatus GA by wrapping the band 10 on the head H and securely fastening hooks and loops 54 and 56. The person then selects a location about the band 10 for securing the anchor number 28 in the corresponding holes 32. (It should be noted herewith that the pins 34 would be removed from the anchor member 28 prior to selecting a desirable location, and once the appropriate location is selected, the pins 34 would be secured back to the anchor number 28 by inserting their screw-threaded bases 35 through the top holes 33 in band 10. In this manner, the anchor member 28 is firmly secured and locked within the band 10.)

The channel members 14 and 16 are then placed over band 10 such that the respective tubular members 22 are received in corresponding pins 34, and interlocked by turning screw-threaded fasteners 24. (It is also noted herewith that the distance 'd' between the two channel members 14 and 16 is preselected such that it corresponds to the width of a conventional hair clipper.) A person may then hold down the rear ends 40 of channel members 14 and 16 with one hand, and cut the hair by sliding the hair clipper HC through the guide tracks 18. This process may be repeated by either rotating the entire guide apparatus GA about the person's head H followed by cutting the hair, or leaving the band in place and selecting another location for the anchor number 28 and repeating the above procedure.

In order to cut the side hair, the anchor member 58 is substituted for the anchor number 28, and the channel members secured in the manner noted above (FIG. 6). In order to cut the side hair at an angle, the tracks 14 and 16 are merely positioned at an angle to the band 10 (towards the front or towards the rear) followed by cutting.

In the haircutting guide apparatus GA of the present invention, the length of the hair to be cut is easily selected by vertically adjusting the distance between the channel members 14 and 16 and the top 11 of the band 10. This is done by turning the fasteners 24 and manipulating the channel members 14 and 16 vertically until a desired height is obtained and then tightening the fasteners 24.

From the above, it can be readily observed that since the channel members 14 and 16 which guide the hair clipper HC, are placed directly over and through the thickness of a person's hair, there is no need to use any extra means to actively pull the hair up through and between the channel members 14 and 16. This construction allows the hair clipper blade to directly contact the thickness of the hair thereby facilitating a more precise and uniform cut. Therefore, the haircutting guide apparatus GA of the present invention can be easily used to cut a person's own hair more uniformly and accurately.

While this invention has been described as having preferred embodiments, it is understood that it is capable of further modifications, uses and/or adaptations following in general the principle of the invention, and including such departures from the present disclosure as those come within the known or customary practice in the art to which the invention pertains, and as may be applied to the central features hereinsetforth and fall within the scope of the invention and the limits of the appended claims.

What is claimed is:

1. A self-haircutting guide apparatus, comprising:

a) a flexible band for securing around a person's head;

b) haircutting guide means including first and second ends;

c) said guide means detachably mounted to said band at one of said first and second ends thereof;

d) said guide means comprising first and second generally opposed channel members defining therebetween a recess for allowing hair to extend therethrough; and e) at least one of the said first and second channel members including a track for guiding a haircutting instrument.

2. The self-haircutting guide apparatus of claim 1, wherein:

a) each of said first and second channel members includes a track.

3. The self-haircutting guide apparatus of claim 2, wherein:

a) said tracks are generally U-shaped.

4. The self-haircutting guide apparatus of claim 1, wherein:

a) said band includes means for orienting said guide means in a selected direction on the person's head.

5. The self-haircutting guide apparatus of claim 4, wherein:

a) said orienting means comprises an anchor member displaceable along the length of said band.

6. The self-haircutting guide apparatus of claim 5, further comprising:

a) means for selectively locking said anchor member on said band.

7. The self-haircutting guide apparatus of claim 6, wherein:

a) said anchor member locking means comprises a plurality of projections and corresponding holes;

b) said projections are located on one of said anchor member and said band; and c) said holes are located on the other of said anchor member and said band.

8. The self-haircutting guide apparatus of claim 5, further comprising:

a) means for connecting said anchor member with said guide means.

9. The self-haircutting guide apparatus of claim 8, wherein:

a) said connecting means comprises at least one pin and a pin receiving member;

b) said pin is located on one of said anchor member and said guide means; and c) said pin receiving member is located on the other of said anchor member and said guide means.

10. The self-haircutting guide apparatus of claim 9, further comprising:

a) means for interlocking said pin and said pin receiving member.

11. The self-haircutting guide apparatus of claim 10, wherein:

a) said interlocking means comprises a screw-threaded fastener.

12. The self-haircutting guide apparatus of claim 1, wherein:

a) the other of said first and second ends of said guide means includes cushion means for holding the guide apparatus against the person's head.

13. The self-haircutting guide apparatus of claim 1, wherein:

a) said haircutting instrument comprises a hair clipper.

14. The self-haircutting guide apparatus of claim 1, in combination with a hair clipper.

* * * * *